US005244783A

United States Patent [19]

Chang

[11] Patent Number: 5,244,783

[45] Date of Patent: Sep. 14, 1993

[54] ROD-SHAPED HOLLOW SILVER HALIDE EMULSIONS AND METHOD OF MAKING

[75] Inventor: Yun C. Chang, Penfield, N.Y.

[73] Assignee: Eastman Kodak Company, Rochester, N.Y.

[21] Appl. No.: 920,065

[22] Filed: Jul. 27, 1992

[51] Int. Cl.[5] ..... G03C 1/015; G03C 1/035

[52] U.S. Cl. ..... 430/567; 430/569; 430/600; 430/614

[58] Field of Search ..... 430/567, 569, 600, 614

[56] References Cited

U.S. PATENT DOCUMENTS 4,914,016 4/1990 Miyoshi et al. ..... 430/614

4,946,772 8/1990 Ogawa ..... 430/567

*Primary Examiner*—Janet C. Baxter

*Attorney, Agent, or Firm*—Carl O. Thomas

[57] ABSTRACT

The present invention is directed to hollow rod-shaped silver halide grains for use in photography and a process for preparation of hollow, rod-shaped grains. The rods have a hexagonal outer periphery, and a hexagonal hollow portion extending longitudinally within the grains.

24 Claims, 2 Drawing Sheets

10 μM

1 μM

ROD-SHAPED HOLLOW SILVER HALIDE EMULSIONS AND METHOD OF MAKING

FIELD OF THE INVENTION

The present invention relates to silver halide emulsions and photographic materials which contain these emulsions. More precisely, the invention relates to processes for precipitating hollow rod-shaped radiation sensitive grain emulsions for use in photography.

BACKGROUND OF THE INVENTION

The most commonly employed photographic elements are those which contain a radiation sensitive silver halide emulsion layer coated on a support. Although other ingredients can be present, the essential components of the emulsion layer are radiation sensitive silver halide microcyrstals, commonly referred to as grains, which form the discrete phase of the photographic emulsion, and a vehicle, which forms the continuous phase of the photographic emulsion.

Silver iodide, silver bromide, silver chloride and crystals consisting of mixtures of these halides are used as silver halides in photographic materials. Crystal structures for these halides range from so-called regular grains such as cubic, tetradecahedral, octahedral, rhombic dodecahedral, etc., to irregular grains such as tabular grains and rod-shaped grains.

Rod-shaped grains can translate into a number of advantages over conventional shaped grains, such as, for example, cubic grains. For example, in comparing two grains having the same grain volume, rod-shaped grains offer more surface area than a comparable volume of cubic grains. An increased surface area translates into potential photographic speed improvements. Further, we can expect better covering power for rod-shaped grains, and for comparable surface area grains, a rod-shaped grain would be expected to provide better granularity (i.e., less graininess). In short, a grain shape which exhibits greater surface area may offer faster speed, better covering power, and an improvement in granularity.

It is known to produce solid rod-shaped grains by utilizing certain growth modifiers during precipitation. U.S. Pat. No. 4,946,772 to Ogawa, for example, discloses the use of aminoazaindene compounds, such as guanine and adenine, as growth modifiers to produce solid rod-shaped silver chloride or silver chlorobromide emulsion grains. Such grains have a relatively low amount of surface per grain.

If one could produce rod-shaped grains whose inside was hollow, the surface area per unit grain would increase significantly. Generally, by increasing the surface area to volume ratio of the grains, the photographic speed and covering power increase, and less granularity is generally realized. The ability of developing solutions to dissolve the silver halide grain also increases as surface area of the grain increases, thereby beneficially effecting processing. Further, the annular opening at the ends of such hollow, rod-shaped grains would permit developer solutions, etc., to flow through the grain thereby further beneficially effecting processing. Hollow rod-shaped grain would also provide an interesting structure for capturing light, which could lead to interesting interference phenomena and other optical properties, which in turn could positively effect photographic performance. Also, compared to solid grains, hollow grains would present a greater amount of silver halide for exposure for equivalent weights of silver halide. This would translate into a cost savings due to the lower amount of silver needed to provide an adequate outside surface area of silver halide grains.

SUMMARY OF THE INVENTION

In accordance with the present invention, a radiation sensitive emulsion is provided which includes hollow rod-shaped silver halide grains and a dispersing medium containing the silver halide grains. The axial cross-section of both the grain and the hollow portion is typically hexagonal. The emulsion preferably contains at least 50 weight percent, and more preferably at least 90 weight percent, of hollow rod-shaped grains.

The method involves controlling the growth of the silver halide crystals, during precipitation, with a quantity of growth modifying agent. Hypoxanthine is the preferred growth modifying agent for the formation of hollow rod-like shapes of the silver halide crystals. Preferably, the emulsion is an aqueous solution.

DETAILED DESCRIPTION OF THE INVENTION

Figure 1:
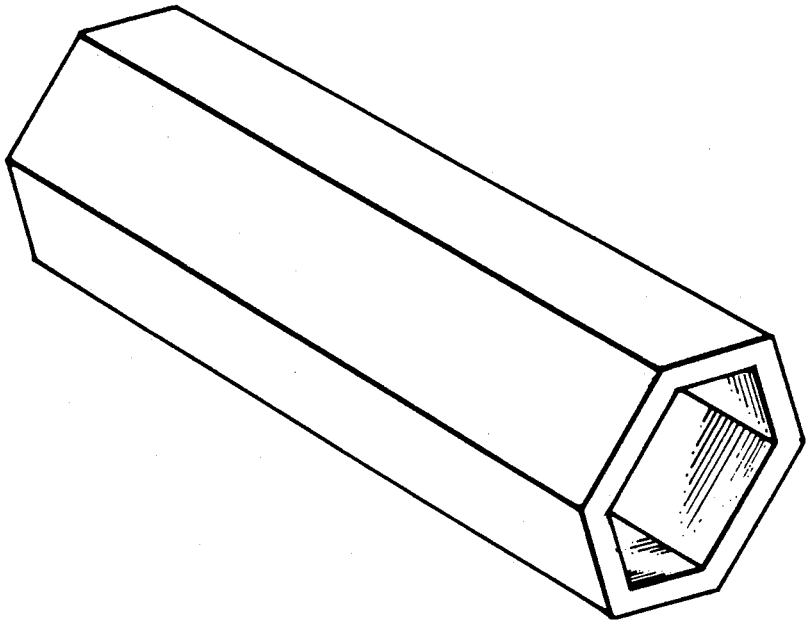
FIG. 1 is a schematic diagram of silver halide grains produced in accordance with the invention.

It has been discovered that hollow rod-shaped silver halide grains can be produced by using suitable crystal growth modifiers during the precipitation process. The hollow rod-shaped grains of this invention consist mainly of grains in which growth has taken place preferentially in one direction relative to the other two directions. Referring to FIG. 1, which is a schematic illustration of grains of the present invention, the grains typically consist of rod-shaped crystals having an axial cross-section which is hexagonal. A hollow passage, which is also hexagonal in axial cross-section, extends length-wise within the crystal the entire length of the crystal. If the length of the grain is taken to be L and the width of the grain is taken to be S, then L preferably satisfies the following relationship:

$$L \geqq 2S$$

More preferably the hollow rod-shaped grains of the present invention preferably satisfy the following relationship:

$$L \geqq 8S$$

Preferred crystal growth modifers for forming hollow, rod-shaped grains in accordance with the present invention are those having the following general form:

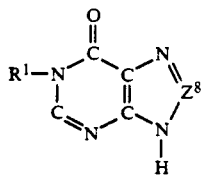

where $Z^8$ is $—C(R^8)$ or $—N=$;

$R^8$ is H, $NH_2$ or $CH_3$; and $R^1$ is hydrogen or a hydrocarbon of from 1 to 7 carbon atoms.

A particularly preferred growth modifying agent is hypoxanthine. The growth modifying agents may be added to the reaction vessel after the commencement of grain formation. Preferably, however, the crystal growth modifying agents are present in the reaction vessel before the start of grain formation wherein the silver halide grains are to be formed by reacting an aqueous solution of water-soluble silver salts with an aqueous solution of halide salts. That is to say, it should be present in the reaction vessel prior to the reaction and it should preferably be present before 70 percent of all the silver halide which is to be formed has been formed. More preferably it should be present before 50 percent of all the silver halide which is to be formed has been formed, and most preferably it should be present before 30 percent of all the silver halide has been formed or it should be placed in the reaction vessel prior to reaction. Provided that it is present in the initial stage of grain formation, an appropriate amount of the crystal growth modifying agent can be included in the later stages of grain formation and supplementary additions can be made without adverse effect on the invention, and in some instances this may be desirable. Hence, in this invention the methods for adding the crystal growth modifying agent include those in which it is dissolved in, and added along with, the silver salt solution or the halide salt solution, those in which it is added as a third solution in parallel with the silver salt solution or the halide salt solution, and those in which the crystal growth modifying agent is divided up and added on a number of occasions during the formation of the grains.

Although no particular limits are imposed on the amounts of the crystal growth modifying agent which is used in this invention, for hypoxanthine a preferred range of concentration is between $1\times10^{-4}$ and 0.1 moles/liter of emulsion. The appropriate amount may vary considerably, however, according to the conditions of use during the formation of the crystal grains, the number and form of grains occurring during precipitation, and the form in which the hollow rod-shaped grains are desired. The amount needed seems to be particularly dependent upon the pH of the dispersing medium during precipitation. If the amount used is too small, for example, hollow rod-shaped grains may not be obtained.

No limits are imposed upon the use conditions when, in this invention, hollow rod-shaped grains are to be formed using growth modifying agents, but the use of these compounds at a pH which is not too low is preferred. For example, a pH during precipitation of at least 8 is preferred. A pH of at least 4.0 throughout the entire process is contemplated. However, this is not a general rule, and hollow rod-shaped grains can be formed in accordance with the present invention at a lower pH.

In a preferred embodiment, the process for forming hollow rod-shaped grains preferably involves first providing an emulsion containing a dispersing medium such as gelatin and a suitable grain growth modifier. Hypoxanthine is the preferred grain growth modifying agent for forming hollow rod-shaped silver halide crystals in accordance with the present invention. Preferably, the emulsion is an aqueous solution. Both oxidized and non-oxidized gelatino peptizers are operable for producing hollow, rod-shaped grains in accordance with the present invention. Throughout the precipitation process, the emulsion is preferably kept at a pH above about 8 and a temperature between about 70° C. and 80° C. Halide ions, preferably of which 90 percent are chloride, are then added to the emulsion. Preferably the dispersing medium contains chloride ion in a concentration range of from $7\times10^{-4}$ to 0.6 mole/liter. Thereafter, silver ions are added as follows: A small quantity, preferably about 1 percent of the total quantity of silver ions to be added, is added first, after which a waiting period is conducted. During the waiting period, which preferably is allowed to continue for at least 1 minute, more preferably at least 10 minutes, and most preferably for at least 40 minutes, grain ripening and crystal growth modification by the growth modifying agent occurs. A relatively large quantity (preferably about 10 percent of the total) of chloride ions preferably is then added quickly (i.e., "dumped") into the vessel. This addition of the concentrated chloride containing solution over a short period of time is commonly referred to as a "dump" of chloride ions. The remainder of the chloride and silver ions are then added in a linearly accelerated addition rate over an additional period, which is preferably more than 30 minutes, and more preferably more than 40 minutes. The dispersing medium has a pAg of about 6.8 during further additions of silver and halide ions. This period is considered the grain growth period. The process is suitable for preparing hollow, rod-shaped silver halide grains, particularly those having high chloride content. Preferably, the halide content of the grains of the present invention consist of at least 80 mole percent, more preferably greater than 90 mole percent, and most preferably greater than 98 mole percent chloride. The remainder of the halide content can be made up of either bromide or iodide, or both. The preferred emulsions prepared according to the present invention are those in which the rod-shaped grains have a length of about 5 microns or more, and account for greater than 20 percent of the total grain projected area. The width of the crystals is preferably less than 1.5 μm and more preferably within the range from 0.1 μm to 1.0 μm. The emulsions typically account for about 90 percent of the total grain projected area. By 90 percent of the total grain projected area, it is meant that, of the total granular surface area produced, about 90 percent is due to hollow rod-shaped grains.

Specific useful forms of gelatin and gelatin derivatives can be chosen, for example, from among those disclosed by Yutzy et al. U.S. Pat. Nos. 2,614,928 and 2,614,929; Lowe et al. U.S. Pat. Nos. 2,614,930 and 2,614,931; Gates U.S. Pat. Nos. 2,787,545 and 2,956,880; Ryan U.S. Pat. No. 3,186,846; Dersch et al. U.S. Pat. No. 3,436,220; Maskasky U.S. Pat. No. 4,713,320; Maskasky U.S. Pat. No. 4,713,323; King et al. U.S. Pat. No.

4,942,120; and Luciani et al. U.K. Pat. No. 1,186,790, all of which are hereby incorporated by reference.

Except for the distinguishing features discussed above, precipitations according to the invention can take conventional forms, such as those described by *Research Disclosure*, Vol. 176, December 1978, Item 17643, Section I, or U.S. Pat. Nos. 4,399,215; 4,400,463; and 4,414,306, all of which are hereby incorporated by reference.

While hollow rod-shaped grains can be produced using the precipitation procedures set forth above, known grain separation techniques, such as differential settling and decantation, centrifuging, and hydrocyclone separation, can, if desired, be employed. An illustrative teaching of hydrocyclone separation is provided by Audran et al. U.S. Pat. No. 3,326,641.

The emulsions of the present invention can contain ionic antifogging agents and stabilizers such as thiols, thiazolium compounds, exemplified by benzothiazolium salts and their selenium and tellurium analogs, thiosulfonate salts, azaindenes and azoles. Also included among these antifoggants and stabilizers are compound classes which, depending on their substituents, can either be ionic or non-ionic; these classes include disulfides, diselenides and thionamides. Also specifically included are non-ionic antifoggants and stabilizers such as the hydroxycarboxylic acid derivatives of W. Humphlett in U.S. Pat. No. 3,396,028.

The hollow rod-shaped grain emulsions can be put to photographic use as precipitated, but are in most instances adapted to serve specific photographic applications by procedures well known in the art. Conventional hardeners can be used, as illustrated by *Research Disclosure*, Item 17643, cited above, Section X. The emulsions can be washed following precipitation, as illustrated by Item 17643, Section 11. The emulsions can be chemically and spectrally sensitized as described by Item 17643, Sections III and IV; or as taught by Kofron et al. U.S. Pat. No. 4,439,520. The emulsions can contain antifoggants and stabilizers, as illustrated by Item 17643, Section VI.

The emulsions of this invention can be used in otherwise conventional photographic elements to serve varied applications, including black-and-white and color photography, either as camera or point materials; image transfer photography; photothermography; and radiography. The remaining sections of *Research Disclosure*, Item 17643; illustrate features particularly adapting the photographic elements to such varied applications.

Modifying compounds other than the crystal growth modifying agents may be used in accordance with the invention during emulsion precipitation. Such compounds can be added initially in the reaction vessel or can be added along with one or more of the peptizer and ions identified above. Examples of such other modifying compounds are copper, thallium, lead, bismuth, cadmium, zinc, middle chalcogens (i.e., sulfur, selenium, and tellurium), gold, and Group VIII noble metals, can be present during precipitation, as illustrated by Arnold et al. U.S. Pat. No. 1,195,432; Hochstetter U.S. Pat. No. 1,951,933; Trivelli et al. U.S. Pat. No. 2,448,060; Overman U.S. Pat. No. 2,628,167; Mueller et al. U.S. Pat. No. 2,950,972; Sidebotham U.S. Pat. No. 3,488,709; Rosecrants et al. U.S. Pat. No. 3,737,313; Berry et al. U.S. Pat. No. 3,772,031; Atwell U.S. Pat. No. 4,269,927; and *Research Disclosure*, Vol. 134, June 1975, Item 13452, all of which are hereby incorporated by reference. It is also possible to introduce one or more spectral sensitizing dyes into the reaction vessel during precipitation, such as cyanines, merocyanines, or other dyes shown in Section IV of *Research Disclosure*, Item 308119, December 1989, or U.S. Pat. No. 4,225,666, both of which are hereby incorporated by reference.

It is important to note once an emulsion has been prepared as described above, any conventional vehicle additives, including other gelatins, can be introduced while still realizing all of the advantages of the invention. Other useful vehicle materials are illustrated by *Research Disclosure*, Item 17643, cited above, Section IX.

The photographic emulsions of the present invention can contain color image forming couplers, i.e., compounds capable of reacting with an oxidation product of a primary amine color developing agent to form a dye. They can also contain colored couplers for color correction or development inhibitor-releasing (DIR) couplers. Suitable couplers for the practice of the present invention are disclosed in Section VII of *Research Disclosure*, hereby incorporated by reference.

The photographic emulsions of the invention can be coated on various supports, preferably flexible polymeric films. Other supports are set forth in Section XVII of *Research Disclosure*, Item 308119, December 1989, hereby incorporated by reference.

Emulsions of the present invention can be applied to a multilayer multicolor photographic material comprising a support on which is coated at least two layers having different spectral sensitivities. Such multilayer multicolor photographic materials usually contain at least one red-sensitive emulsion layer, at least one green-sensitive emulsion layer, and at least one blue-sensitive emulsion layer. The order of these layers can be optionally selected as desired. Usually a cyan-forming coupler is associated with the red-sensitive layer, a magenta-forming coupler is associated with the green-sensitive layer, and a yellow-forming coupler is associated with the blue-sensitive layer.

The photographic emulsions of the present invention can be processed with black and white developing agents such as hydroquinones, 3-pyrazolidones, or other compounds such as those disclosed in Section XX of *Research Disclosure*, Item 308119, December 1989, hereby incorporated by reference. Primary aromatic amine color developing agents (e.g., 4-amino-N-ethyl-N-hydroxyethylaniline or 3-methyl-4-amino-N,N-diethylaniline) can also be employed. Other suitable color developing agents are described in L. F. A. Mason, *Photographic Processing Chemistry*, Focal Press, 1966, pp. 226–229, and in U.S. Pat. Nos. 2,193,015 and 2,592,364.

Photographic emulsions of the present invention can be applied to many different silver halide photographic materials such as, high speed and other black and white films, X-ray films, and multilayer color negative films, including those having diffusion transfer applications.

EXAMPLES

The invention can be better appreciated by reference to the following specific examples. In each of the examples a reaction vessel equipped with a stirrer was used. The contents of the reaction vessel were stirred vigorously during the entire precipitation process.

Examples 1, 2, 3 and 4 utilize hypoxanthine as a grain modifier, along with some novel precipitation techniques to produce hollow, rod-shaped silver chloride grains. During the precipitation of all of the following example emulsions, the pH was maintained at 8, and the temperature was maintained at 80° C.

Grain characteristics of the various emulsions prepared in the following examples were determined from photomicrographs and are summarized in Table I below. The heading gel type refers to the type of gelatin, oxidized or regular (non-oxidized) that was employed. Grain composition refers to the chemical composition of the resultant grain. Length refers to the length of the resultant rod-shaped grains, and diameter refers to the approximate diameter of the resultant grains. Percent rods by area refers to the percentage of the total granular surface area due to hollow, rod-shaped grains.

EXAMPLE 1

The reaction vessel was charged with 5600 grams of distilled water containing 50 grams of oxidized gelatin, 2 grams of hypoxanthine., 2.5 grams of NaCl, and 1 cc of polypropylene oxide antifoamant. The pH was adjusted to 8 at 80° C. and maintained at that value throughout the precipitation by addition of NaOH or HNO3. A 4 molar AgNO3 solution was added over a 2.5 minute period at a rate consuming 1.0 percent of the total Ag used. The emulsion was then allowed to sit at 80° C. for approximately 40 minutes (this was a ripening step during which the growth modifier and the grains interact with each other), followed by a 100 cc dump of 4 molar NaCl solution. Further silver and chloride containing solutions were then added simultaneously with a linearly accelerated addition rate over an additional period of 40 minutes (10X from start to finish) during which time the remaining 99 percent of the Ag was consumed (this was a growth period during which the grains were allow to grow). The pAg was maintained at 6.8 during the growth period. The total amount of silver precipitated was 3.9 moles.

EXAMPLE 2

This example was identical to Example 1 in all respects except that regular (unoxidized) gelatin was used. As illustrated in Table I, the use of the non-oxidized gelatin in this case resulted in hollow, rod-shaped grains which were shorter and wider than those formed in Example 1.

Figure 2:
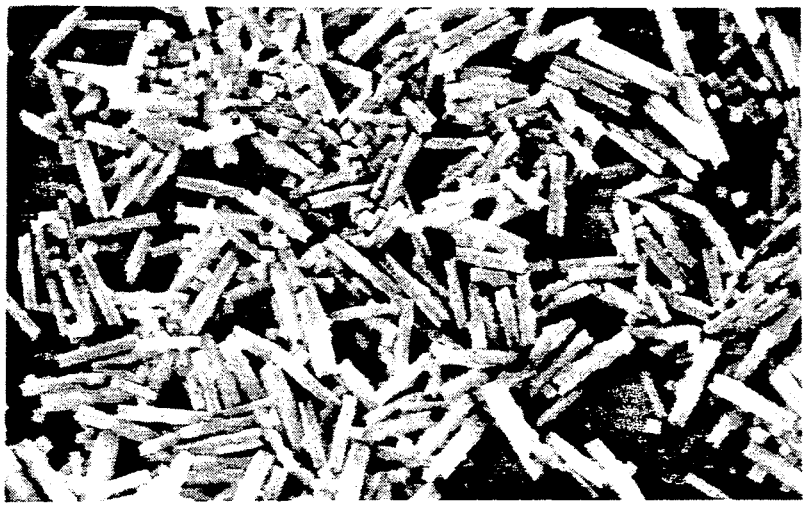
FIG. 2 is a carbon replica micrograph of silver halide grains produced in accordance with the method disclosed in Example 2.
Figure 3:
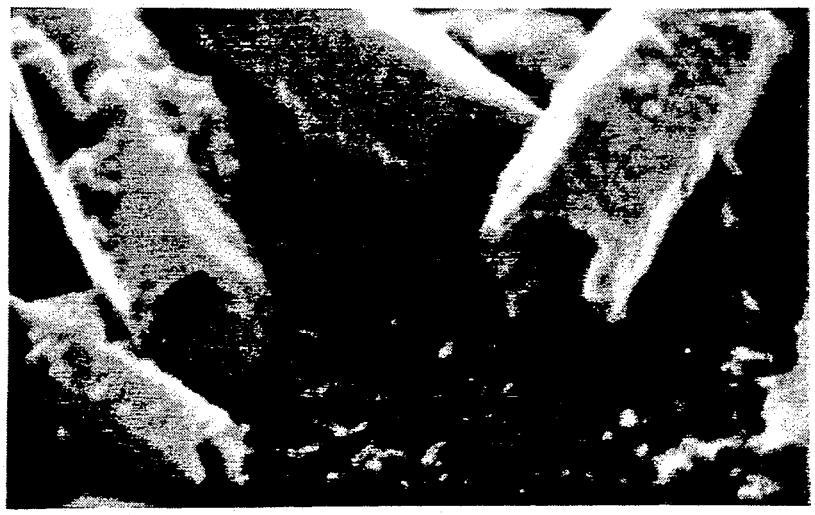
FIG. 3 is an enlarged carbon micrograph of the silver halide grains illustrated in FIG. 2.

FIGS. 2 and 3 are carbon replica micrographs of grains in the resultant emulsion formed in Example 2. FIG. 3 clearly illustrates the hexagonal rod-shaped grains having hollow end faces. The hollow portion extends relatively evenly throughout the entire length of the grain.

EXAMPLE 3

This emulsion was similar to Example 1 in all respects except that the linearly accelerated addition rate during the growth period was halted at 25 minutes. As a result, a total of only 1.84 moles of silver was precipitated. In addition, these grains were shorter and slightly wider than those formed in Example 1, although they also were hollow and rod-shaped.

EXAMPLE 4

Using the emulsion produced in Example 3, a salt solution of 0.5 molar NaBr and 4 molar NaCl was added simultaneously with 4 molar AgNO3 solution for five minutes at 20 cc/min. The silver halide grains of the resulting emulsion contained 2.0 mole percent bromide. A summary of the resulting emulsion appears in Table I.

TABLE I

| Example | Gel Type | Grain Composition | Length (μm) | Diameter (μm) | % Rods by area |
|---|---|---|---|---|---|
| 1 | oxidized | AgCl | 6 | 0.7 | 90 |
| 2 | non-oxidized | AgCl | 4 | 1.2 | 90 |
| 3 | oxidized | AgCl | 2.0 | 1.0 | 90 |
| 4 | oxidized | $AgCl_{.98}Br_{.02}$ | 2.8 | 1.2 | 90 |

The invention has been described in detail with particular reference to preferred embodiments thereof, but it will be understood that variations and modifications can be effected within the spirit and scope of the invention.

What is claimed:

1. A radiation-sensitive emulsion comprising: hollow rod-shaped silver halide grains; and a dispersing medium containing said silver halide grains.

2. A radiation-sensitive emulsion according to claim 1, wherein said halide comprises at least 90 percent chloride.

3. A radiation-sensitive emulsion according to claim 1, wherein said rod-shaped grains extend longitudinally between opposed ends and have a cross-section across the length of said grains which extend longitudinally between opposed ends and is hexagonal.

4. A radiation-sensitive emulsion according to claim 1, wherein the hollow rod-shaped silver halide grains extend longitudinally between opposed ends and have a hollow passage extending longitudinally within the grains between the opposed ends.

5. A radiation-sensitive emulsion according to claim 4, wherein the cross-section across the length of said passage is hexagonal.

6. A radiation-sensitive emulsion according to claim 1, wherein said dispersing medium comprises a gelatin peptizer.

7. A radiation-sensitive emulsion according to claim 1, wherein the silver halide grains are spectrally sensitized.

8. A radiation-sensitive emulsion according to claim 1, wherein the silver halide grains are chemically sensitized.

9. A radiation-sensitive emulsion comprised of hollow rod-shaped silver halide grains;

a dispersing medium containing said silver halide grains; and a crystal growth modifying agent adsorbed onto said silver halide grains having the structure:

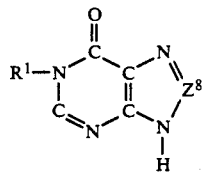

where $Z^8$ is $—C(R^8)$ or $—N=$;

$R^8$ is H, $NH_2$ or $CH_3$; and $R^1$ is hydrogen or a hydrocarbon of from 1 to 7 carbon atoms.

10. A radiation-sensitive emulsion according to claim 9, wherein said growth modifying agent is hypoxanthine.

11. A process for producing a radiation-sensitive emulsion containing hollow rod-shaped silver halide grains, said process comprising:

providing silver ions, halide ions and a growth modifying agent of the following form:

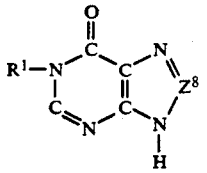

where $Z^8$ is $—C(R^8)$ or $—N=$;

$R^8$ is H, $NH_2$ or $CH_3$; and $R^1$ is hydrogen or a hydrocarbon of from 1 to 7 carbon atoms; in a dispersing medium, allowing grain growth to occur for a period of at least 1 minute during which no silver ions or halide ions are added to the dispersing medium, and thereafter adding further quantities of silver and halide ions to said dispersing medium.

12. A process according to claim 11, wherein said growth modifying agent is hypoxanthine.

13. A process according to claim 12, wherein the concentration of said growth modifying agent in said dispersing medium is between about $1\times10^{-4}$ and 0.1 moles/liter.

14. A process according to claim 11, wherein said providing comprises:

adding said growth modifying agent to said dispersing medium before at least one of said silver ions or said halide ions.

15. A process according to claim 11, wherein said providing comprises:

adding said growth modifying agent to said dispersing medium after at least one of said silver ions or said halide ions.

16. A process according to claim 11, wherein said dispersing medium is a gelatino peptizer.

17. A process according to claim 11, wherein said halide ions include chloride.

18. A process according to claim 17, wherein said dispersing medium contains chloride ion in a concentration range of from $7\times10^{-4}$ to 0.6 moles/liter.

19. A process according to claim 11, wherein said halide ions include bromide.

20. A process according to claim 11, further comprising:

dumping chloride ions in said dispersing medium after the grain growth period and prior to said adding further quantities of silver and halide ions.

21. A process according to claim 11, wherein throughout the entire process, said dispersing medium has a pH of at least 4.

22. A process according to claim 11, wherein throughout the entire process, said dispersing medium has a pH of at least 8.

23. A process according to claim 11, wherein said dispersing medium has a pAg below about 7.5 during said adding further quantities of silver and halide ions.

24. A process according to claim 11, wherein the pAg of said dispersing medium has a pAg of about 6.8 during said adding further quantities of silver and halide ions.

* * * * *